US006614149B2

(12) United States Patent
Kastalsky et al.

(10) Patent No.: US 6,614,149 B2
(45) Date of Patent: Sep. 2, 2003

(54) FIELD-EMISSION MATRIX DISPLAY BASED ON LATERAL ELECTRON REFLECTIONS

(75) Inventors: Alexander Kastalsky, Wayside, NJ (US); Sergey Shokhor, Sound Beach, NY (US); Frank J. DiSanto, North Hills, NY (US); Denis A. Krusos, Lloyd Harbor, NY (US); Boris Gorfinkel, Saratov (RU); Nikolai Abanshin, Saratov (RU)

(73) Assignees: CopyTele, Inc., Melville, NY (US); Volga Svet Ltd., Saratov (RU)

( * ) Notice: Subject to any disclaimer, the term of this patent is extended or adjusted under 35 U.S.C. 154(b) by 0 days.

(21) Appl. No.: 10/102,467

(22) Filed: Mar. 20, 2002

(65) Prior Publication Data

US 2002/0135284 A1 Sep. 26, 2002

Related U.S. Application Data

(60) Provisional application No. 60/284,864, filed on Apr. 19, 2001, and provisional application No. 60/277,171, filed on Mar. 20, 2001.

(51) Int. Cl.[7] ..... H01J 1/00; H01J 1/05; H01J 1/14; H01J 19/06

(52) U.S. Cl. ..... 313/310; 313/495; 313/496; 313/497; 313/346 R; 313/311; 313/336

(58) Field of Search ..... 313/310, 311, 313/309, 336, 351, 326, 346 R; 445/24, 50; 315/169.1, 169.4; 345/60, 61, 66, 67, 68

(56) References Cited

U.S. PATENT DOCUMENTS

| | | | | | |
|---|---|---|---|---|---|
| 5,192,240 | A | * | 3/1993 | Komatsu | 445/24 |
| 5,214,347 | A | | 5/1993 | Gray | 313/355 |
| 5,382,867 | A | * | 1/1995 | Marno et al. | 313/309 |
| 5,528,099 | A | * | 6/1996 | Xie et al. | 313/309 |
| 5,965,971 | A | | 10/1999 | Karpov | 313/309 |
| 6,023,126 | A | | 2/2000 | Karpov | 313/310 |

FOREIGN PATENT DOCUMENTS

| | | |
|---|---|---|
| RU | 2022393 | 10/1994 |
| RU | 2075130 | 3/1997 |
| RU | 2089960 | 9/1997 |
| RU | 2097869 | 11/1997 |

* cited by examiner

*Primary Examiner*—Nimeshkumar D. Patel
*Assistant Examiner*—Mariceli Santiago
(74) *Attorney, Agent, or Firm*—Duane Morris LLP

(57) ABSTRACT

A Reflective Field Emission Display system, components and methods for fabricating the components. In the FED system, a plurality of reflective edge emission pixel elements are arranged in a matrix of N rows and M columns, the pixel elements contain an edge emitter that is operable to emit electrons and a reflector that is operable to extract and laterally reflect emitted electrons. A collector layer, laterally disposed from said reflector layer is operable to attract the reflected electrons. Deposited on the collector layer is a phosphor layer that emits a photon of a known wavelength when activated by an attracted electron. A transparent layer that is oppositely positioned with respect to the pixel elements is operable to attract reflected electrons and prevent reflected electrons from striking the phosphor layer. Color displays are further contemplated by incorporating individually controlled sub-pixel elements in each of the pixel elements. The phosphor layers emit photons having wavelengths in the red, green or blue color spectrum.

24 Claims, 4 Drawing Sheets

FIELD-EMISSION MATRIX DISPLAY BASED ON LATERAL ELECTRON REFLECTIONS

PRIORITY FILING DATE

This application claims the benefit of the earlier filing date, under 35 U.S.C. §119, of commonly-owned U.S. Provisional Patent Applications;

Ser. No. 60/277,171, entitled "New Edge-Emission Matrix Display," filed on Mar. 20, 2001; and Ser. No. 60/284,864, entitled "Field-Emission Matrix Display Based on Electron Reflections," filed on Apr. 19, 2001.

RELATED INVENTIONS

This application is related to commonly assigned U.S. patent application:

Ser. No. 10/102,450, entitled "Field-Emission Matrix Display Based on Electron Reflection," filed on Mar. 20, 2002; and Ser. No. 10/102,472, entitled "Pixel Structure for an Edge-Emitter Field-Emission Display," filed on Mar. 20, 2002, the disclosures of which are incorporated by reference herein.

1. Field of the Invention

The present invention relates to solid-state displays and more specifically to reflective field emission displays.

2. Background of the Invention

Solid state and non-Cathode Ray Tube (CRT) display technologies are well-known in the art. Light Emitting Diode (LED) displays, for example, include semiconductor diode elements that may be arranged in configurations to display alphanumeric characters. Alphanumeric characters are then displayed by applying a potential or voltage to specific elements within the configuration. Liquid Crystal Displays (LCD) are composed of a liquid crystal material sandwiched between two sheets of a polarizing material. When a voltage is applied to the sandwiched materials, the liquid crystal material aligns in a manner to pass or block light. Plasma displays conventionally use a neon/xenon gas mixture housed between sealed glass plates that have parallel electrodes deposited on the surface.

Passive matrix displays and active matrix displays are flat panel displays that are used extensively in laptop and notebook computers. In a passive matrix display, there is a matrix or grid of solid-state elements in which each element or pixel is selected by applying a potential to a corresponding row and column line that forms the matrix or grid. In an active matrix display, each pixel is further controlled by at least one transistor and a capacitor that is also selected by applying a potential to a corresponding row and column line. Active matrix displays provide better resolution than passive matrix displays, but they are considerably more expensive to produce.

While each of these display technologies has advantages, such as low power and lightweight, they also have characteristics that make them unsuitable for many other types of applications. Passive matrix displays have limited resolution, while active matrix displays are expensive to manufacture.

Hence, there is a need for a low-cost, lightweight, high-resolution display that can be used in a variety of display applications.

SUMMARY OF THE INVENTION

A Reflective Field Emission Display (FED) system using reflective field emission pixel elements is disclosed. In the FED system disclosed, pixel elements are composed of at least one edge emitter, a reflector and a laterally opposed collector layer. The reflector layer attracts and reflects electrons that are extracted from an edge emitter. The reflected electrons are laterally attracted to an associated collector layer. A phosphor layer deposited on the collector layer emits photons when bombarded by reflected electrons attracted to the collector layer. In another aspect of the invention, a transparent layer is positioned opposite the emitter edge and is operable to inhibit reflected electrons from being attracted to the collector layer.

Figure 1A:
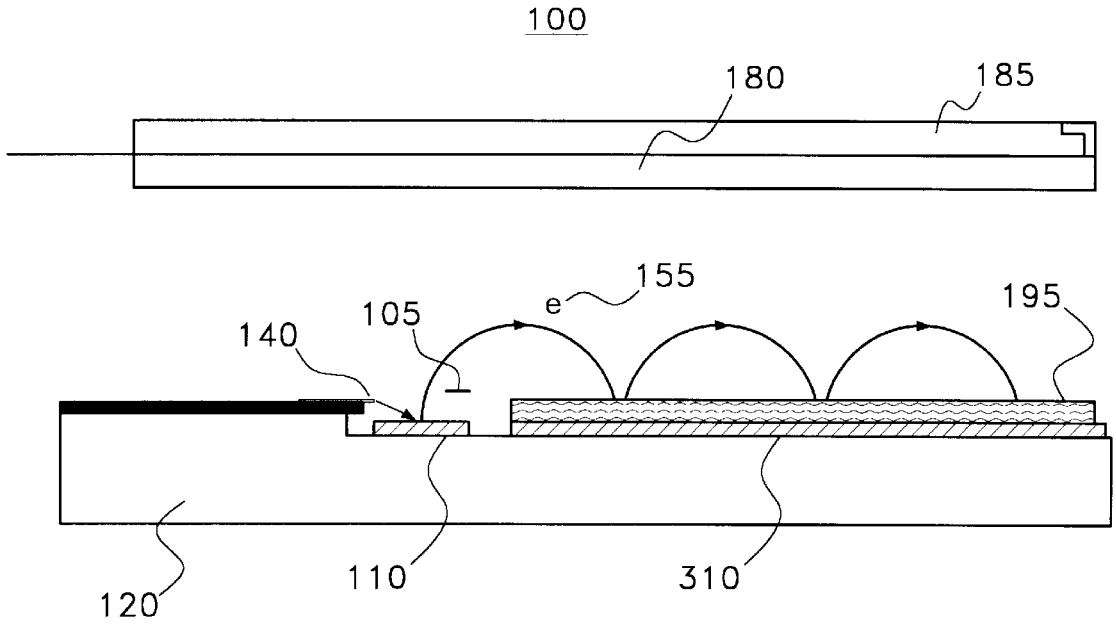
FIG. 1*a* illustrates a cross-sectional view of an Field-Emission Display (FED) pixel element in accordance with the principles of the invention.

It is to be understood that these drawings are solely for purposes of illustrating the concepts of the invention and are not intended as a definition of the limits of the invention. It will be appreciated that the same reference numerals, possibly supplemented with reference characters where appropriate, have been used throughout to identify corresponding parts.

DETAILED DESCRIPTION OF THE INVENTION

FIG. 1*a* illustrates a cross-sectional view of a FED pixel element 100 using lateral electron reflection. Well 105 is fabricated in substrate 120 using well-known etching techniques such as photo-resistant masking. Emitter layer 140 is then deposited on substrate 120 such that the edge of emitter 140 extends over well 105.

First electrode 110 and second electrode 310 are then deposited in well 105. Second electrode 310 is laterally positioned and electrically isolated from first electrode 110. First electrode 110, referred to herein as a reflector layer, and second electrode 310, referred to herein as a collector layer, may be selected from a group of materials having a high efficiency of conductivity and reflectivity, such as gold (Au), silver (Ag), aluminum (Al), copper (Cu) chromium (Cr), niobium (Nb), vanadium (V), molybdenum (Mo), etc. In a preferred embodiment, reflector layer 110 is aluminum while collector layer 310 is chromium.

Phosphor layer 195 is next deposited on collector layer 310. Phosphor layer 195 produces a predetermined or desired level of photonic activity or illumination when activated or bombarded by an impinging electron 155, which is laterally reflected from reflector layer 110 and attracted to collector layer 310.

Glass plate or transparent substrate 185 is separated from the emitter edge element 170 by a small distance, preferably in the range of 100–200 microns. The small separation distance prevents any significant broadening of the reflected electron beam. Hence, a small spot of phosphor luminescence and consequently, good display resolution are achieved. Furthermore, the small separation distance prevents the development of multiple electron reflections on top glass 190. Transparent electrode layer (ITO) 180 is disposed on transparent material 185, which is placed on pixel element 100 and electrically isolated from emitter layer 140. ITO layer 180 is operable to attract electrons from reflector layer 110 and, thus, prevent electron flow to collector 310. In this manner, ITO layer 180 operates to modulate the light intensity emitted from phosphor layer 195. Although not shown, it would be appreciated that a dielectric material, such as $SiO_2$, separates transparent substrate 190/ITO layer 10 and emitter layer 140.

In another aspect of the invention, ITO layer 180 may be formed into electrically isolated conductive stripes arranged in columns, orthogonal to pixel elements formed in rows, as will be further explained. In this aspect, a high constant voltage may be applied to selected electrically conductive lines within ITO layer 180 such that electrons 155 emitted from selected emitter layer 140 edges and reflected from reflector layer 110 are attracted to selected conductive lines on ITO 180. Selective control line activation on ITO layer 180 is advantageous when different color phosphors are used, as in a color display.

As will be appreciated, the gap between the emitter layer 140 and reflector layer 110 can be made extremely small, preferably within one (1) micron. In this case, the voltage difference between emitter layer 140 and reflector 110 can be reduced to a level between 30 and 100 volts. Similarly, the voltage on collector layer 310 is maintained such that the difference between voltages on the reflector layer 110 and collector layer 310 is sufficient to attract reflected electrons 15. In a preferred embodiment, the voltage difference between reflector layer 110 and collector layer 310 is in the order of 100–200 volts. Similarly, the voltage or potential of the ITO layer 180 is selectively maintained at a significantly known voltage, substantially the same as or greater than the voltage on collector layer 310. The voltage on ITO layer typically a is in the order of 300–400 volts greater than that of the collector voltage when it is desired that electrons 150 not bombard a corresponding phosphor layer.

As will be appreciated, ITO layer 180 may be deposited on top of viewing glass 185. In a second aspect, ITO layer 180 is interposed between glass 185 and emitter layer 140. In still another aspect of the invention, ITO layer 180 may be formed into electrically isolated conductive stripes arranged in columns, orthogonal to pixel elements formed in rows, as will be further explained. In this aspect, a high constant voltage may be applied to selected electrically conductive lines within ITO layer 180 such that electrons emitted from selected emitter layer 140 edges and reflected from reflector layer 110 are attracted to selected conductive lines on ITO layer 180 rather than an associated phosphor layer/collector layer.

It would be appreciated that connectivity layers having a high electrical conductivity, may be deposited between substrate 120 and each of reflector element 110 and collector element 310. Each connectivity layer may be used to supply a potential or voltage to each associated reflector 110 and collector 310. FIG. 1*c* illustrates an aspect of the invention, wherein connectivity layer 115 is imposed between substrate 120 and reflector element 110.

Figure 1B:
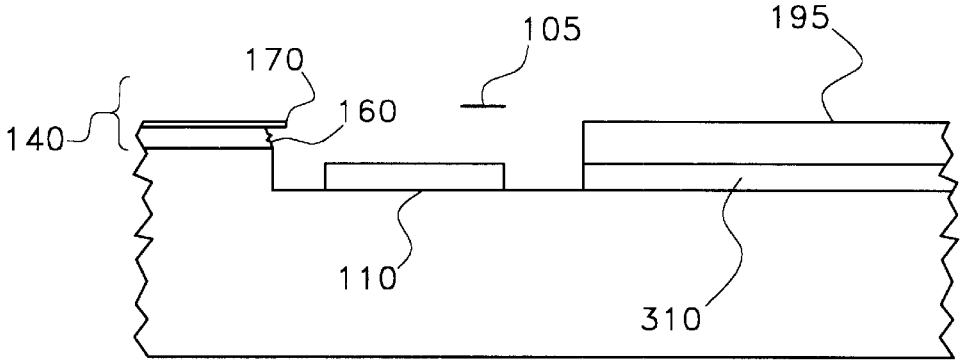
FIG. 1*b* illustrates a cross-sectional view of an FED pixel element in accordance with a second aspect of the invention.
Figure 1C:
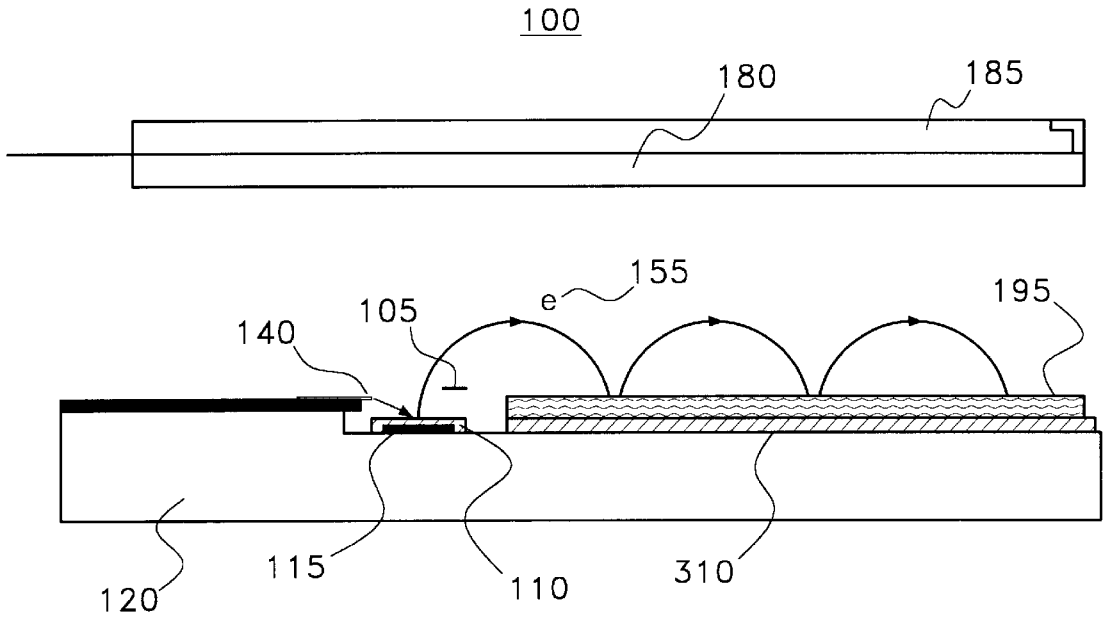
FIG. 1*c* illustrates a cross-sectional view of an FED pixel element in accordance with a second embodiment of the invention.

FIG. 1*b* illustrates a preferred embodiment of emitter layer 140. In this preferred embodiment, emitter layer 140 includes bottom conductive layer 160 and emitter edge layer 170. Conductive layer 160 is used as an electrical contact to emitter edge layer 170. In this aspect, emitter edge layer 170 is formed as an edge of a 50–80 nanometer-thick (nm) alpha-carbon thin film. Alpha-carbon film is well known to have a low work function for electron emission into a vacuum. In another aspect of the invention, a resistive material, such as alpha-silicon ($\alpha$-Si), may be imposed between conductive layer 160 and emitter edge 170 to provide additional series resistance in the emitter-reflector circuit.

Figure 2A:
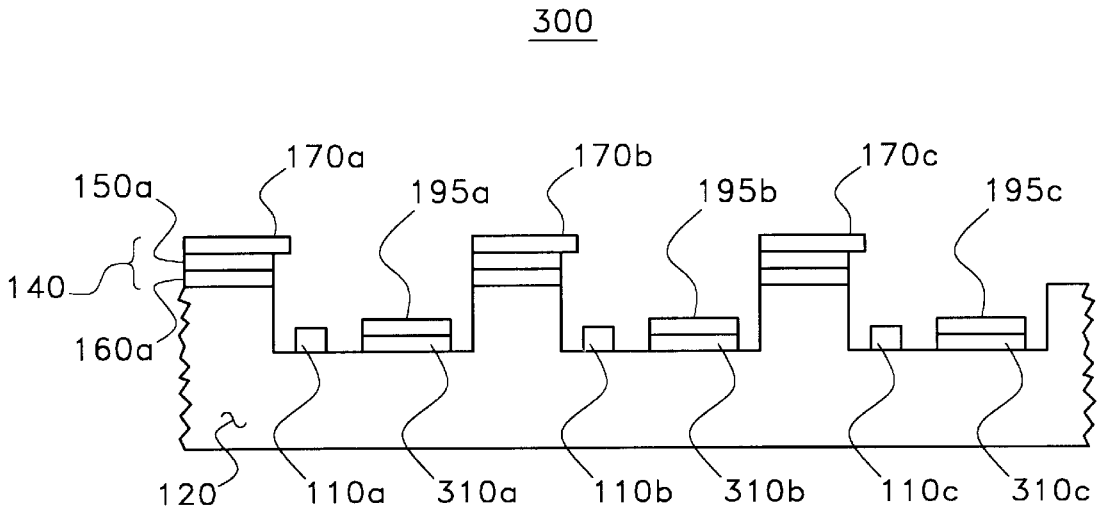
FIG. 2*a* illustrates a cross-sectional view of an full-color FED pixel element in accordance with a second aspect of the invention

FIG. 2*a* illustrates a cross-section of an exemplary full-color FED pixel element in accordance with a second aspect of the invention. In this aspect, a plurality of wells are fabricated in substrate 120. Within each well is deposited a reflector layer, represented as 110*a*, 110*b*, 110*c*, and a corresponding collector layer, represented as 310*a*, 310*b*, 310*c*. Deposited on each collector layer is a phosphor layer, represented as 195*a*, 195*b*, 195*c*. Each phosphor layer is representative of a phosphor that emits a photon of a known wavelength when activated by an electron reflected from a corresponding reflector layer and attracted to a corresponding collector layer. In a preferred embodiment, phosphor layers 195*a*, 195*b*, 195*c* are selected from a group that emit photons in the red, blue or green color wavelength spectrum.

Although not shown, it would be appreciated that a connectivity layer, having a high electrical conductivity, may be deposited between each of the illustrated reflector elements 110*a*, 110*b*, 110*c* and collector elements 310*a*, 310*b*, 310*c*. The connectivity layer may be used to supply a potential or voltage to each associated reflector and collector layers.

Furthermore, ITO layer 180 layer may be fabricated in electrically conductive strips positioned opposite corresponding wells in substrate 140. Conductive strips in ITO layer 180 may selectively prevent different number of electrons reflected from reflector layers 110*a*, 110*b*, 110*c*, from being attracted to corresponding collector layers, 310*a*, 310*b*, 310*c*.

Figure 2B:
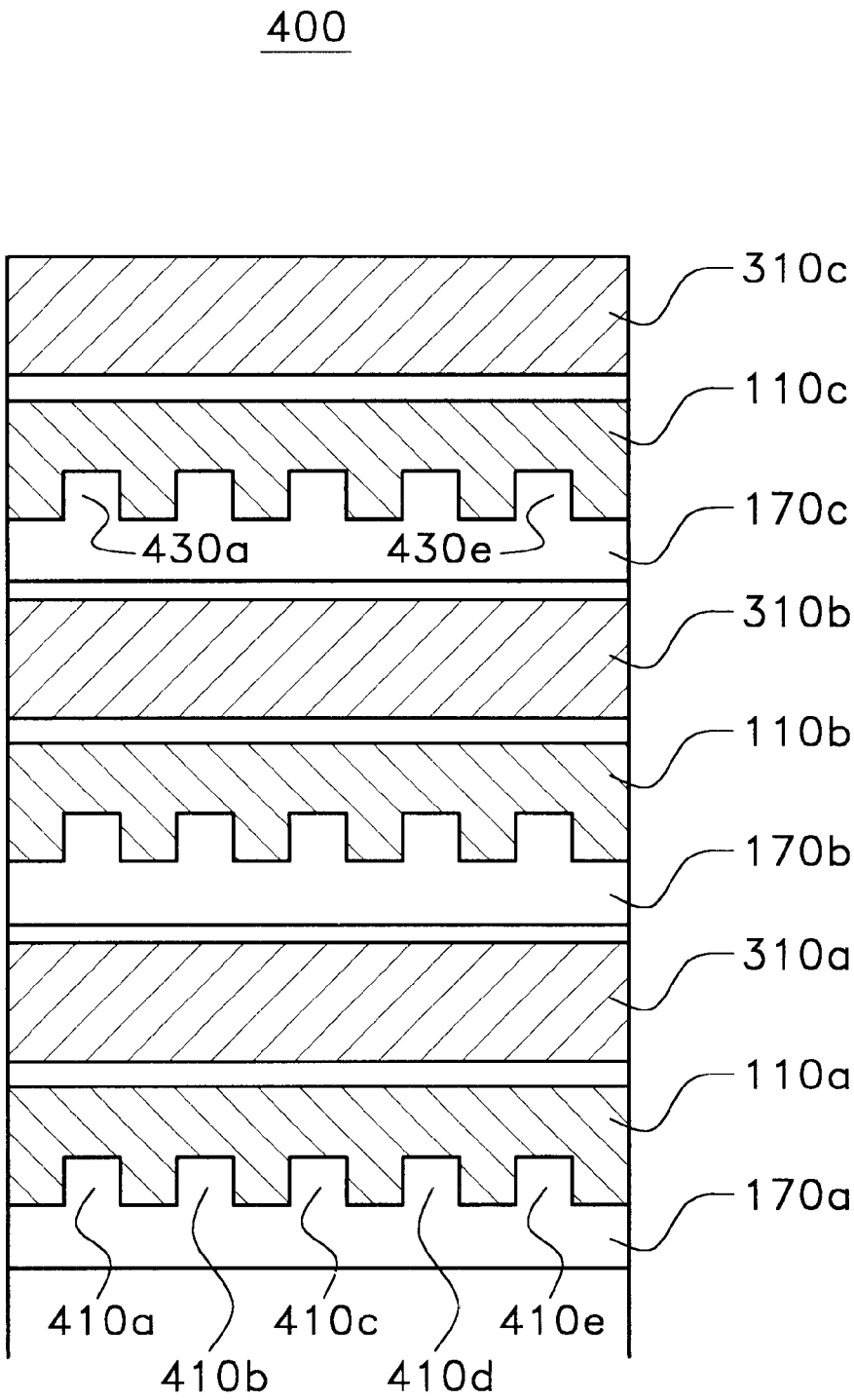
FIG. 2*b* illustrates a top view of an FED pixel element illustrated in FIG. 2*a*.

FIG. 2*b* illustrates a top view 400 of a full-color pixel element 300 depicted in FIG. 2*a*. In this illustrated view, emitter edge 170*a*, 170*b*, 170*c*, are positioned over corresponding reflector layer 110*a*, 110*b*, 110*c* and are preferably distributed as a "comb" having a plurality of tangs, prongs, fingers or digits. For example, emitter layer edge 170*a* is distributed in digits represented as 410*a*–410*f*, and emitter layer edge 170*c* is distributed in digits represented as 430*a*–430*f*. In this manner, the length of emitter layer 140 edge is substantially increased.

Figure 3:
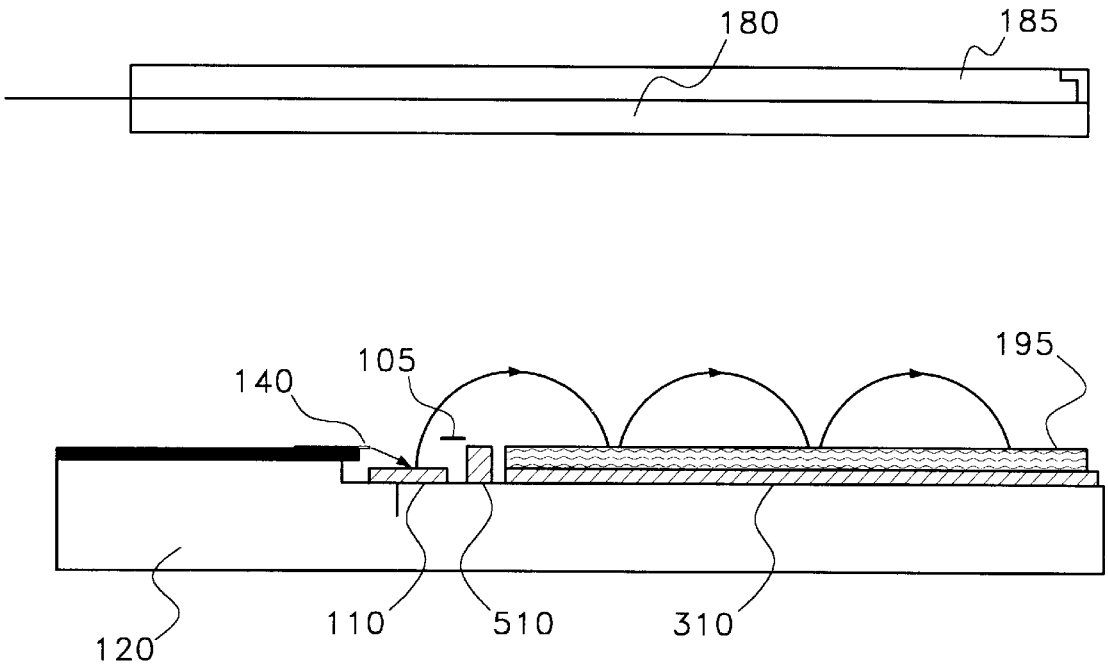
FIG. 3 illustrates a cross-sectional view of a second embodiment of an FED pixel element.

FIG. 3 illustrates a second exemplary embodiment of a pixel element in accordance with the principles of the present invention. In this illustrative embodiment, barrier layer 510 is imposed between reflector layer 110 and collector layer 310. In this embodiment, barrier layer 510 is maintained at a potential to prevent electrons laterally reflected from reflector 110 from merely striking an edge of collector layer 310 closest to reflector 110. Barrier layer 510 is conductive material such as aluminum, niobium, vanadium, molybdenum, etc.

As would be understood by those skilled in the art, a sold-state flat panel display using laterally reflected pixel elements disclosed herein may be formed by arranging a plurality of pixel elements, for example, pixel 100, emitter layers 140 electrically connected in rows and reflector layers 110 and 310 are arranged in columns. Pixel elements may then be selected to produce an image viewable through transparent layer 185 by the application of voltages to selected rows and columns. Control of selected rows and columns may be performed by any means, for example, a processor, through appropriate row controller circuitry and column controller circuitry. As will be appreciated, a processor may be any means, such as a general purpose or special purpose computing system, or may be a hardware configuration, such as a dedicated logic circuit, integrated circuit, Programmable Array Logic, Application Specific Integrated circuit that provides known voltage outputs on corresponding row and column lines in response to known inputs.

Pixel control may be obtained by sub-dividing the total emitter-reflector voltage difference into a known constant voltage Vo and a variable voltage ΔV, which may be pulsed. Constant voltage Vo may be applied as a negative voltage or a zero voltage, which may indicate a particular row is activated. A positive variable voltage ΔV may then be applied to reflector 110 to activate the emission at the desired row-column intersection. Furthermore, a zero voltage as a column voltage corresponds to the non-activated pixel. Hence, a pixel is in its on-state when a negative voltage Vo relative to the reflector is applied to the row containing emitter 140 and a positive ΔV voltage is applied to the column containing reflector 110.

In one aspect of the invention, voltages may be alternatively applied to reflector layers or collector layers in a sequential manner for a fixed duration of time related to a frame time. For example, a voltage is applied as illustrated to a single reflector layer 110*a* or a single collector layer 310*a*, as shown in FIG. 1*a*, while a low or no voltage is applied to other reflector layers 110*b*, 110*c* or collector layers, i.e., 310*b*, 310*c*. Hence, electrons are drawn from a single emitter or attracted to a single phosphor layer in a sequential manner. In a preferred embodiment, voltage is sequentially applied to each desired layer for one-third ($1/3^{rd}$) of the display frame time. Time-sequential application of voltage is advantageous as the number of line drivers is reduced and beam-spreading and pixel cross-talk are reduced. Time-sequential application of a voltage may similarly be applied to corresponding ITO layer 180 strips.

As is well known in the art, masking for example, using photo-resistance masks is accomplished over that portion of the metal that is not to be removed, while exposing the unwanted portion. The exposed portion is then removed by subjecting the multi-layer structure to a metal etching process. There are several different etching processes available to those skilled in the art. Furthermore, the term "deposited" as used in this written description includes means for forming or growing on a material layer on a surface by exposing the surface to the material. Vapor deposition, thermal growth, oxidation and sputtering are examples of deposition processes that can be used in accordance with the principles of the present invention.

While there has been shown, described, and pointed out, fundamental novel features of the present invention as applied to preferred embodiments thereof, it will be understood that various omissions and substitutions and changes in the apparatus described, in the form and details of the devices disclosed, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated.

We claim:

1. A reflective emission pixel device comprising:

a substrate layer;

at least one first electrode deposited on said substrate;

at least one second electrode deposited on said first surface adjacently disposed from a corresponding one of said at least one first electrode;

at least one third electrode deposited on said substrate adjacently disposed from a corresponding one of said at least one first electrode an emitter layer deposited on said at least one third electrode having an edge for electron emission extending above said at least one first electrode, means to apply a first potential applied to said at least one first electrode to attract electrons from said emitter layer to said first electrode;

means to apply a second potential applied to said at least one corresponding second electrode to attract electrons from a corresponding first electrode; and a transparent electrode layer oppositely opposing said substrate layer and electrically isolated from said emitter layer, said transparent electrode layer having means to apply a third potential to attract electrons from said first electrode.

2. The device as recited in claim 1 further comprising:

a phosphor layer deposited on corresponding ones of said at least one second electrodes.

3. The device as recited in claim 2, wherein said at least one phosphor layer emits a known wavelength when bombarded by electrons.

4. The device as recited in claim 2, wherein said phosphor layer further comprises:

a plurality of phosphor layers.

5. The device as recited in claim 2, wherein said phosphor layer emits a photon at a wavelength selected from the group comprising:

red, green, blue.

6. The device as recited in claim 1 further comprising:

a connectivity layer deposited between said first electrode and said substrate.

7. The device as recited in claim 6, wherein said connectivity layer is selected from the electrically conductive group comprising;

gold, silver, aluminum, copper, chromium, niobium, vanadium, molybdenum.

8. The device as recited in claim 1 further comprising:

a connectivity layer deposited between each of said at least one second electrodes and said substrate.

9. The device as recited in claim 1, wherein said electrodes are selected from the group comprising;

gold, silver, aluminum, copper, chromium, niobium, vanadium, molybdenum.

10. The device as recited in claim 1, wherein each of said at least one emitter layer further comprises:

a conductive layer; and an emitter edge layer in contact with said conductive layer.

11. The device as recited in claim 10, wherein said emitter edge layer is an alpha-carbon.

12. The device us recited in claim 10 further comprising:

a resistive layer imposed between said conductive layer and said emitter edge layer.

13. The device as recited in claim 12, wherein said resistive layer is an alpha-silicon material.

14. The device as recited in claim 1, wherein said at least one emitter layer is distributed within said pixel.

15. The device as recited in claim 14, wherein said at least one emitter layer is subdivided into a plurality of digits.

16. The device as recited in claim 1 further comprising:

a barrier layer between each of said first electrode and corresponding second electrode.

17. The device as recited in claim 16, wherein a known potential is applied to said barrier layer.

18. A reflective field edge emission display system comprising:

a FED display comprising:

a plurality of reflective edge emission pixel elements arranged in a matrix of N rows of emitters and M columns of reflectors and associated collector elements, wherein said pixel element comprises an edge emitter operable to emit electrons, at least one reflector operable to reflect electrons, at least one collector layer operable to attract said reflected electrons and a phosphor layer deposited on each of said at least one collector layer;

a transparent layer oppositely positioned to said plurality of pixel elements, said transparent layer operable to selectively attract said reflected electrons;

a row selector operable to apply a known potential to selected ones of said N rows through an associated emitter;

a column selector operable to apply a second known potential to selected ones of said M columns through an associated one of said reflector layers and a third known potential to a corresponding one of said collector layers;

a transparent layer controller operable to selectively apply a fourth known potential to selected regions of said transparent layer;

means to select at least one of said N rows, at least one of said M columns and at least one selectable region of said transparent layer.

19. The system as recited in claim 18, wherein said phosphor layer is operable to emit a light having a known color when activated.

20. The system as recited in claim 18, wherein said at least one phosphor layer emits a photon having a known wavelength when activated.

21. The system as recited in claim 20, wherein said wavelength is selected from the group comprising:

red, green, blue.

22. The system as recited in claim 18, wherein said edge emitter is distributed within said pixel to increase the edge of the emitter layer.

23. The system as recited in claim 22, wherein said edge emitter is subdivided into a plurality of digits.

24. The system as recited in claim 18, wherein said pixel element further comprises:

a barrier layer positioned between said reflector layer and a corresponding collector layer.

* * * * *